US012070645B2

(12) United States Patent
Diguardi et al.

(10) Patent No.: US 12,070,645 B2
(45) Date of Patent: Aug. 27, 2024

(54) ADJUSTABLE AND FILLABLE WEIGHT PLATE

(71) Applicants: David Diguardi, Ontario, NY (US); Mark Fleming, Manhattan Beach, CA (US)

(72) Inventors: David Diguardi, Ontario, NY (US); Mark Fleming, Manhattan Beach, CA (US)

( * ) Notice: Subject to any disclaimer, the term of this patent is extended or adjusted under 35 U.S.C. 154(b) by 180 days.

(21) Appl. No.: 17/976,780

(22) Filed: Oct. 29, 2022

(65) Prior Publication Data

US 2024/0139574 A1 May 2, 2024

(51) Int. Cl.
*A63B 21/06* (2006.01)
*A63B 21/072* (2006.01)

(52) U.S. Cl.
CPC ..... *A63B 21/0603* (2013.01); *A63B 21/072* (2013.01)

(58) Field of Classification Search
CPC ..... A63B 21/072; A63B 21/0603; A63B 21/0602; A63B 21/075; A63B 21/4035; A63B 21/0726; A63B 21/0601; A63B 21/0724; A63B 21/06; A63B 21/0728; A63B 21/0604; A63B 2210/50
See application file for complete search history.

(56) References Cited

U.S. PATENT DOCUMENTS 3,171,652 A * 3/1965 Newman ..... A63B 21/0724 482/106
3,226,117 A * 12/1965 Walklet ..... A63B 21/0603 482/106
3,463,486 A * 8/1969 James, Jr. ..... A63B 21/0728 482/106
3,572,702 A * 3/1971 Dorn ..... A63B 21/0724 482/106
5,967,952 A * 10/1999 Bronstein ..... A63B 21/0606 482/106
2005/0096195 A1* 5/2005 Morrissette ..... A63B 21/06 482/93
2006/0073949 A1* 4/2006 Cao ..... A63B 21/0728 482/106
2009/0093348 A1* 4/2009 Wang ..... A63B 21/0603 482/93
2009/0227431 A1* 9/2009 Hsieh ..... A63B 21/072 482/98
2014/0243166 A1* 8/2014 Lister ..... B29B 17/0042 264/319

(Continued)

FOREIGN PATENT DOCUMENTS

WO WO-2013181757 A2 * 12/2013 ..... A63B 21/0602

OTHER PUBLICATIONS

CN-111840892-A and Machine Translation thereof (Year: 2020).*
CN 111840892 and Machine Translation thereof (Year: 2020).*

*Primary Examiner* — Sundhara M Ganesan
(74) *Attorney, Agent, or Firm* — Larisa Migachyov

(57) ABSTRACT

An adjustable weight plate to be used with a standard or Olympic barbell handle, comprising a wide opening that is easy to fill with sand or other loose filler material, multiple inner compartments to separate out the sand and equalize the weight, and reinforcing dividers to strengthen the weight plate. The adjustable weight plate also comprises a metal collar to strengthen the inner radius of the weight plate, and an easy-fill funnel to fill the weight plate with sand.

15 Claims, 8 Drawing Sheets

(56) References Cited

U.S. PATENT DOCUMENTS

| | | | | |
|---|---|---|---|---|
| 2016/0051856 | A1* | 2/2016 | Breitkreutz | A63B 21/0603<br>482/93 |
| 2020/0197740 | A1* | 6/2020 | Liu | B23P 15/00 |
| 2022/0111243 | A1* | 4/2022 | Flom | A63B 21/072 |

* cited by examiner

ADJUSTABLE AND FILLABLE WEIGHT PLATE

CROSS-REFERENCE TO RELATED APPLICATIONS

None.

BACKGROUND

Field of the Invention

The present invention relates to weights used for weight training, and specifically to weights that can be filled with sand or other loose materials to adjust their weight.

Background of the Invention

Weight training is a popular athletic activity, and many people like to work out at home by lifting weights. While some people use small weights to do so, the more advanced forms of weight training require a barbell and large weight plates. Usually, these plates range in weight from 1 pound to 100 pounds, and are made of cast iron. As an athlete gets stronger, they add more weight plates or put larger weight plates on their barbell.

While it is easy to store large numbers of heavy weight plates at a gym, it is harder to store them in a home setting, because they are bulky and heavy. Furthermore, even purchasing such weights is complicated. If the customer goes to the sports supply store in person, this will involve hauling large numbers of cast iron plates (and those weights are less and less available at these stores at all). If the customer orders them online, as is increasingly common, this will involve huge shipping fees that often cost as much as the weights themselves. This renders cast iron weights undesirable for home gym setups.

Adjustable weights that can be filled with sand or water are available for the home gym setting. Such weights are typically made of hollow plastic and include a hole through which the weight can be filled.

Unfortunately, these adjustable weights are typically not strong enough to stand up to the kind of use that an advanced weight trainer might require. Typically, an athlete using a barbell might drop it on the ground from waist height, which would seriously damage a typical hollow plastic weight, and would repeatedly put it on and take it off a barbell, which would quickly damage the plastic. Also, 100 pounds of sand would be heavy enough to break a typical plastic adjustable weight, since their plastic walls are not strong enough to stand up to the load. There is nothing on the market that provides an adjustable weight that can be used with an Olympic barbell.

Finally, an adjustable weight is typically completely hollow inside. This leads the sand to shift during use. On a barbell plate, this would lead to an unbalanced weight, which may be harder to use or even cause injury.

A need exists for an adjustable weight plate that can be used with a standard or Olympic barbell, that can easily be filled with large quantities of sand or other filler to make it usable for serious weight training, that can be shipped easily without huge shipping fees, and that can stand up to the typical use required for advanced weight training.

SUMMARY OF THE INVENTION

An object of the present invention is to provide an adjustable weight plate for barbell or dumbbell weight training that is strong enough for the typical use required for advanced weight training.

Another object of the present invention is to provide an adjustable weight plate for barbell or dumbbell weight training that is easy to fill and to empty.

Another object of the present invention is to provide an adjustable weight plate for barbell or dumbbell weight training that is well-balanced.

The present invention is a hollow weight plate that may be used with a standard or Olympic barbell or dumbbell for weight training. The hollow weight plate may be filled with material, such as sand or lead shot or other loose material, to adjust its weight. The hollow weight plate comprises a main body that has a flat, circular bottom side with a circular hole in the middle. An outer cylindrical wall extends from the outside of the circular bottom side to form the exterior of the hollow weight plate. An inner cylindrical wall extends from the edge of the circular hole to form the inner side of the hollow weight plate. At least two dividers extend from the inner cylindrical wall to the outer cylindrical wall to separate the interior of the hollow weight plate into at least two separate interior compartments. In other embodiments, there may be four, six, or more interior compartments. The outer cylindrical wall, inner cylindrical wall, and the at least two dividers are approximately the same height. The hollow weight plate also comprises a top side that may be formed out of the same piece of material as the main body or may be a separate piece of material. The top cover comprises a larger hole that exposes at least a portion of each of the interior compartments.

The hollow weight plate also comprises a center collar cover, which comprises a collar flat portion and a circular hole from which a collar cylindrical wall extends. The collar cylindrical wall is of a size that fits inside the inner cylindrical wall. The center collar cover is fastened on the top side of the main body so that the collar flat portion covers the top hole and the collar cylindrical wall is inside the inner cylindrical wall.

The present invention may also include a funnel for filling the hollow weight plate with sand or other filler material. The funnel comprises a larger opening for pouring the sand and a smaller opening through which the sand goes into the interior compartments. The smaller opening also comprises a cover located in the middle of the smaller opening to prevent the sand from pouring through the inner cylindrical wall.

The center collar cover may be made of metal and the main body may be made of plastic or rubber.

In an embodiment, the interior surface of the top side is slanted so that the distance between the bottom surface of the top side and the bottom side is greater near the center than it is at the outer edge.

The filler material may be sand or any other loose material. In an embodiment, the filler material may comprise a cementing agent to bind it into a solid.

In an embodiment, at least one of the interior compartments comprises at least one internal stiffener, shaped in such a way as to minimize movement of the filler material inside the weight during use. The internal stiffener may have a honeycomb structure.

The hollow weight plate may have an inner diameter of 1", to fit a standard barbell or dumbbell handle, or an inner diameter of 2", to fit an Olympic barbell handle.

LIST OF FIGURES

DETAILED DESCRIPTION OF THE PREFERRED EMBODIMENT

Figure 1A:
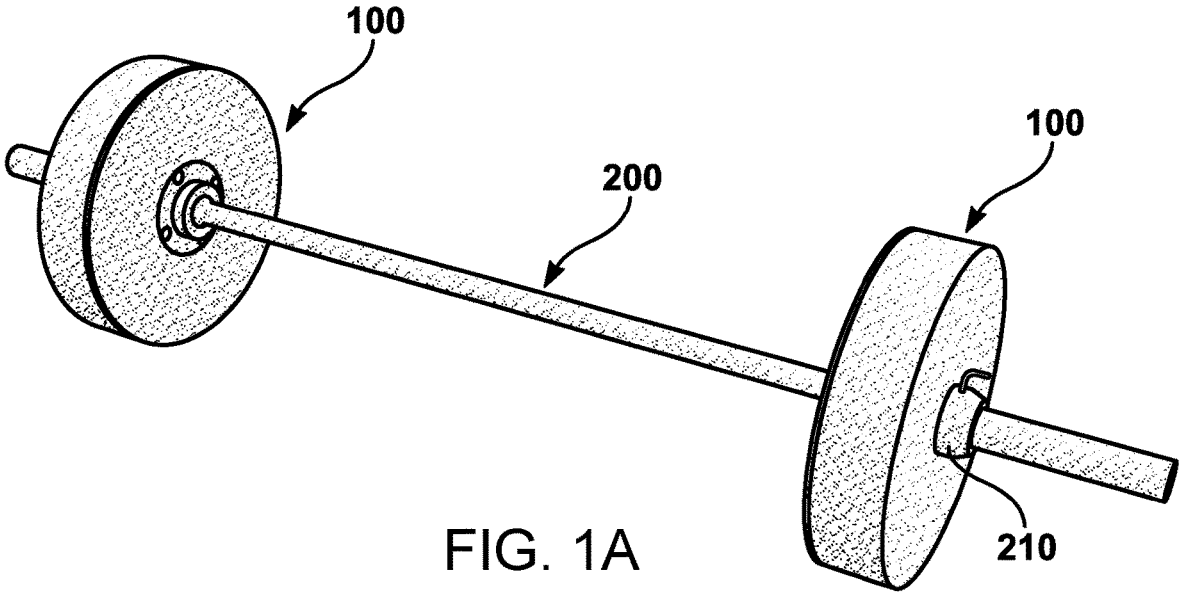
FIG. 1A is a view of an embodiment of the present invention used on a barbell.
Figure 1B:
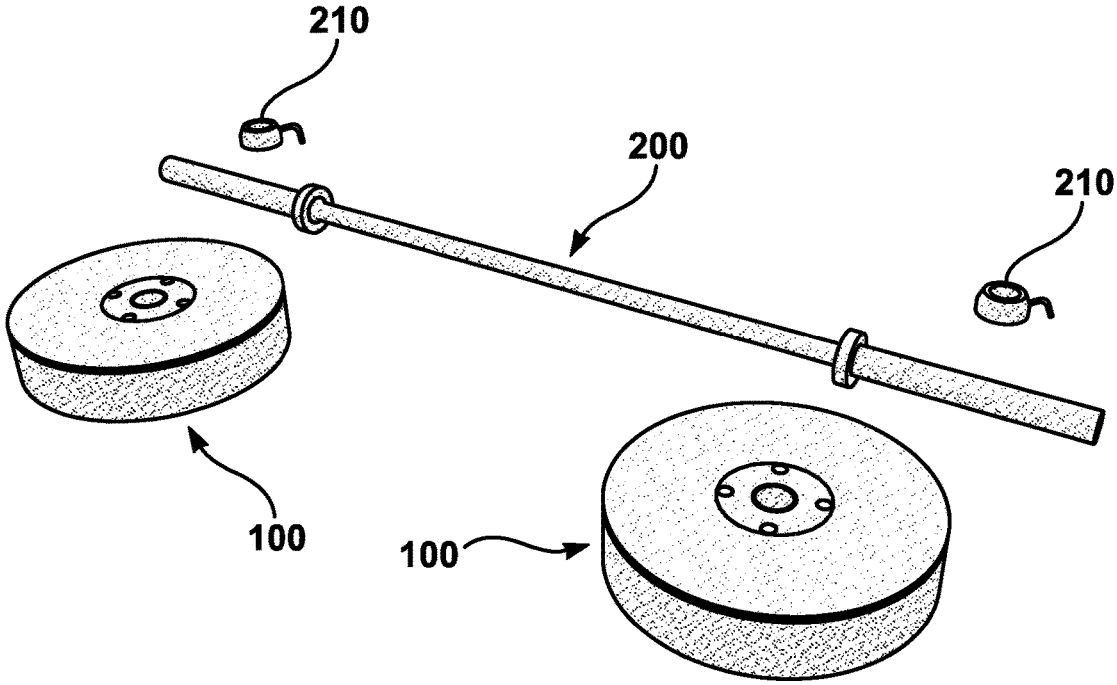
FIG. 1B is a view of an embodiment of the present invention used on a barbell, disassembled.

FIGS. 1A and 1B show two hollow weight plates 100 according to an aspect of the present invention being used on a barbell 200. A locking ring 210 is used to keep the weight plates 100 in place, the way that it would be used for a standard weight plate. The hollow weight plates 100 are preferably dimensioned in such a way as to fit on a standard-sized barbell with a 1" diameter, or an Olympic barbell with a 2" diameter. An Olympic barbell is shown in the Figure. The hollow weight plate of the present invention may also be used on a dumbbell in the same way.

It is to be understood that while only one hollow weight plate is shown on each side of the barbell 200, any number of weight plates may be used on each side in order to increase the weight, as is standard practice in weight training.

An aspect of the present invention is a hollow weight plate intended to be filled with loose filler material, such as sand, gravel, or lead shot. The amount of loose filler material may be adjusted to make the weight heavier or lighter as desired by the user. In an embodiment, the loose filler material may solidify after it is poured into the hollow weight plate—for example, concrete may be used. The present disclosure is not meant to be limiting as to the type of filler material may be used; however, for purposes of the below description, the use of sand is implied.

Figure 2:
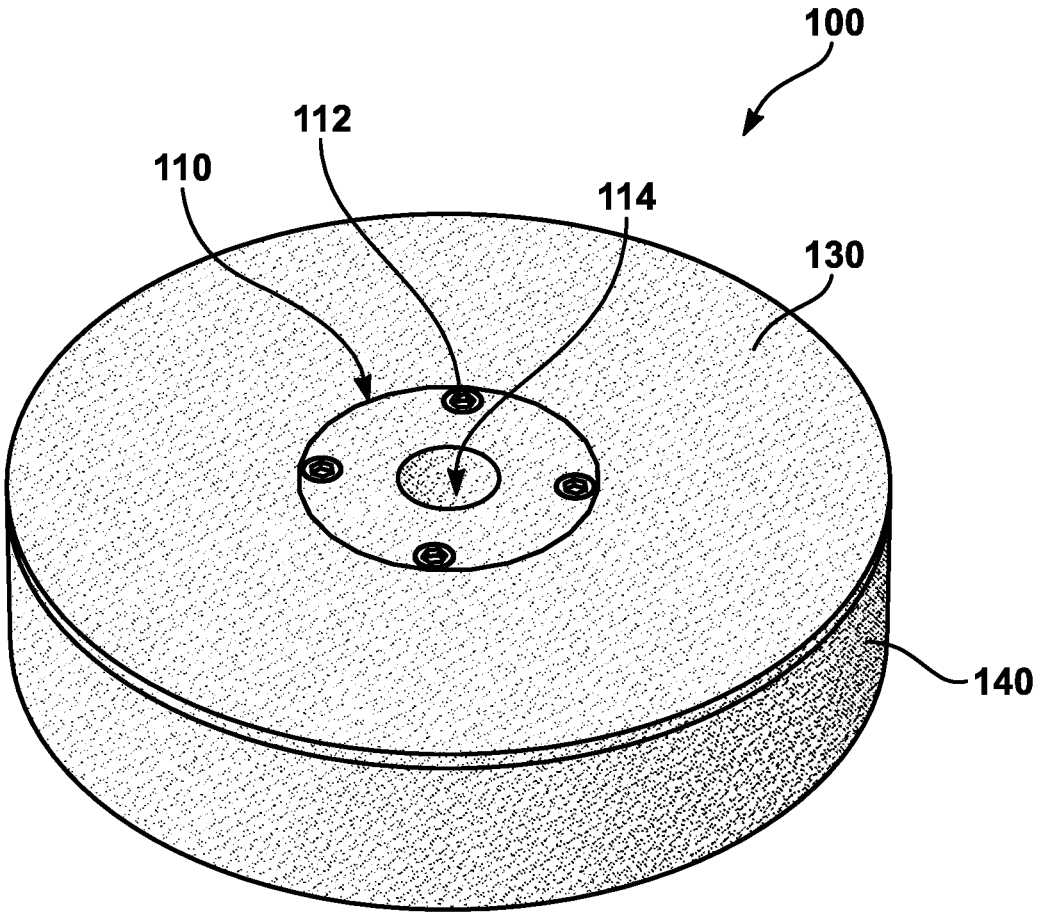
FIG. 2 is a view of an embodiment of a weight plate of the present invention.

FIG. 2 shows a view of a hollow weight plate 100, seen from the outside. The main body 140 comprises a top side 130 attached rigidly to the remainder of the main body 140. The top side 130 may be formed of the same piece of material as the remainder of the main body or may be a different piece of material permanently or removably attached. Preferably, the main body (including the top side) is made of plastic or hard rubber.

As can be seen in FIG. 2, the hollow weight plate 100 also comprises a center collar cover 110, which is preferably attached to the hollow weight plate 100 with several fasteners 112. The function of the center collar cover 110 is to seal the hollow interior of the hollow weight plate to prevent the sand or other loose filler material from leaking out, and also to interface with the barbell 200. For strength and resistance to friction, the center collar cover 110 is preferably made of metal, such as steel. This would enable it to support the hollow weight plate 100 while it is on a barbell (or while it is being dropped to the ground from waist-height), and to withstand the repeated friction of installing and removing the hollow weight plate on the barbell.

Figure 3:
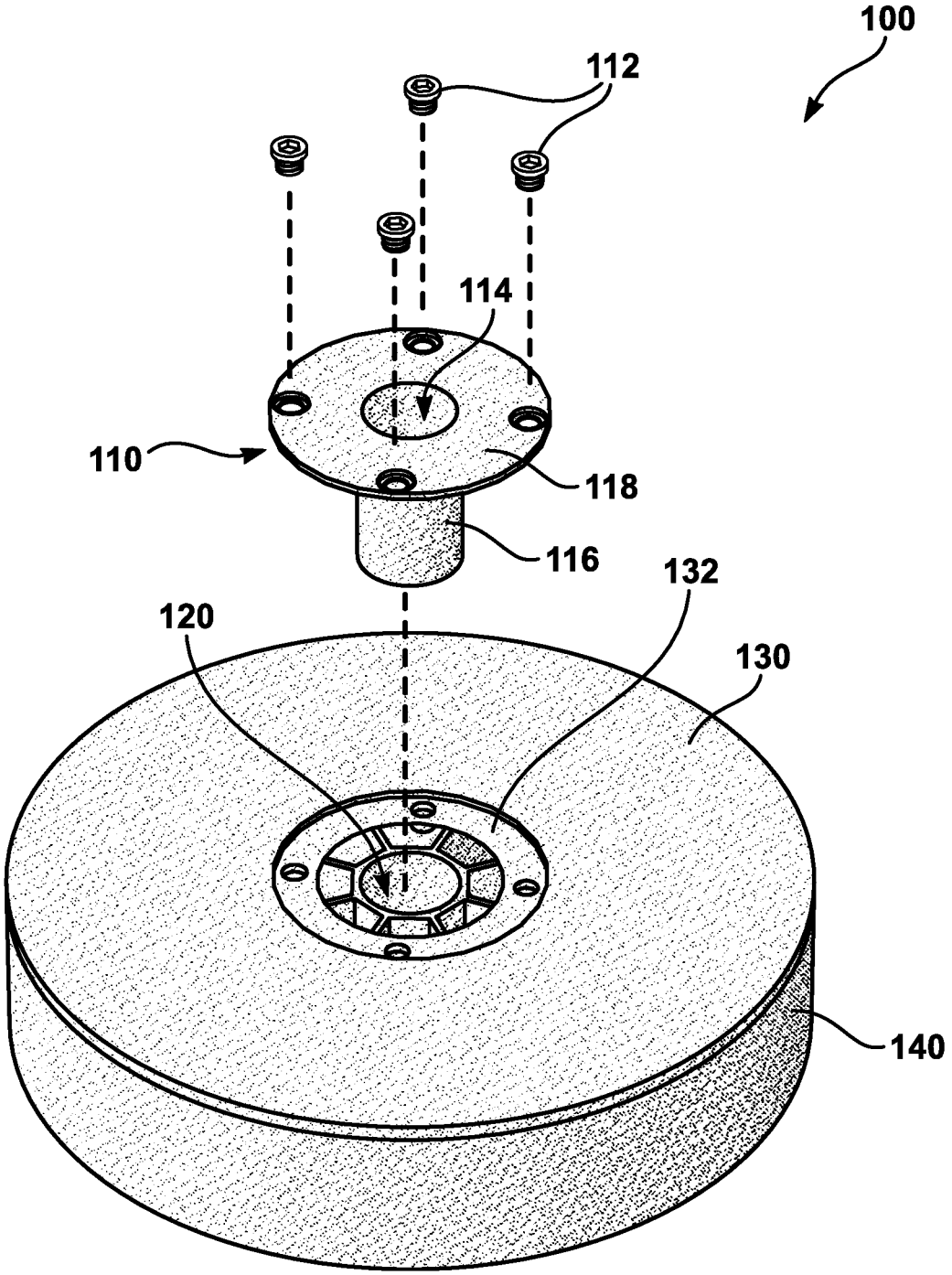
FIG. 3 is an exploded view of an embodiment of a weight plate of the present invention.

FIG. 3 shows an exploded view of the hollow weight plate 100. As can be seen, the center collar cover 110 comprises a collar flat cover (the flat portion of the part) 118 and a cylindrical portion 116. The cylindrical portion 116 fits into the inner cylindrical wall 120 on the main body 140. This reinforces the hollow weight plate at a vulnerable point and provides a more stable support for the collar flat cover as it is attached to the main body 140. Furthermore, the fact that the center collar cover 110 comprises both a flat portion and a cylindrical portion renders it better at sealing the interior of the main body of the hollow weight plate, preventing filler material from leaking out.

Figure 4:
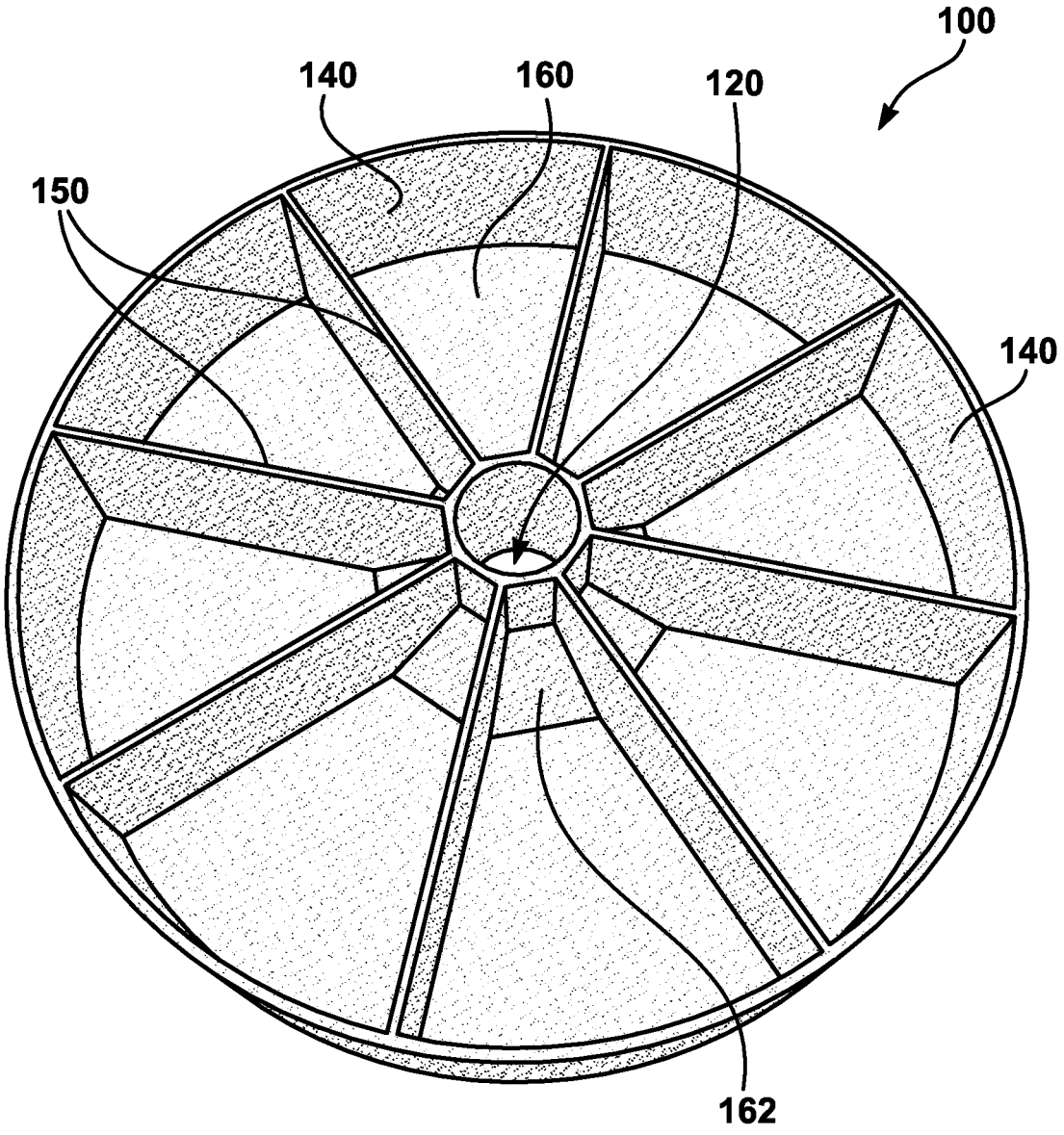
FIG. 4 is a view of an interior of the main body of an embodiment of a weight plate of the present invention.

FIG. 4 shows an interior view of the main body with the top side off. As can be seen, the interior of the main body is hollow, defined by an inner cylindrical wall and an outer cylindrical wall. The interior of the main body is also separated into multiple compartments 160 by dividers 150. While eight compartments are shown in the Figure, it is to be understood that any number greater than or equal to two is included with the present invention. The compartments 160 serve the purpose of separating the loose filler material into sections so that it does not all collect at the bottom of the weight when the hollow weight plate is in use. This enables the hollow weight plate to be better balanced and prevents excessive loading on the interior walls. Furthermore, the dividers 150 serve an important structural purpose in stiffening the hollow weight plate and providing structural stability. The wall thickness of the hollow main body and the dividers depends on the material from which they are made, but should be such that the hollow weight plate can withstand the load of the filler material without breaking or leakage, even when dropped on the ground from a reasonable height with filler material inside.

As can be seen in FIG. 3, when the center collar cover 110 is taken off, portions of each compartment 160 are visible through the hole in the top side. The hollow weight plate is filled through that hole by means of a funnel, described below. Because each compartment is equally exposed through the hole, each compartment can be filled simultaneously with an approximately equal amount of sand.

Figure 5:
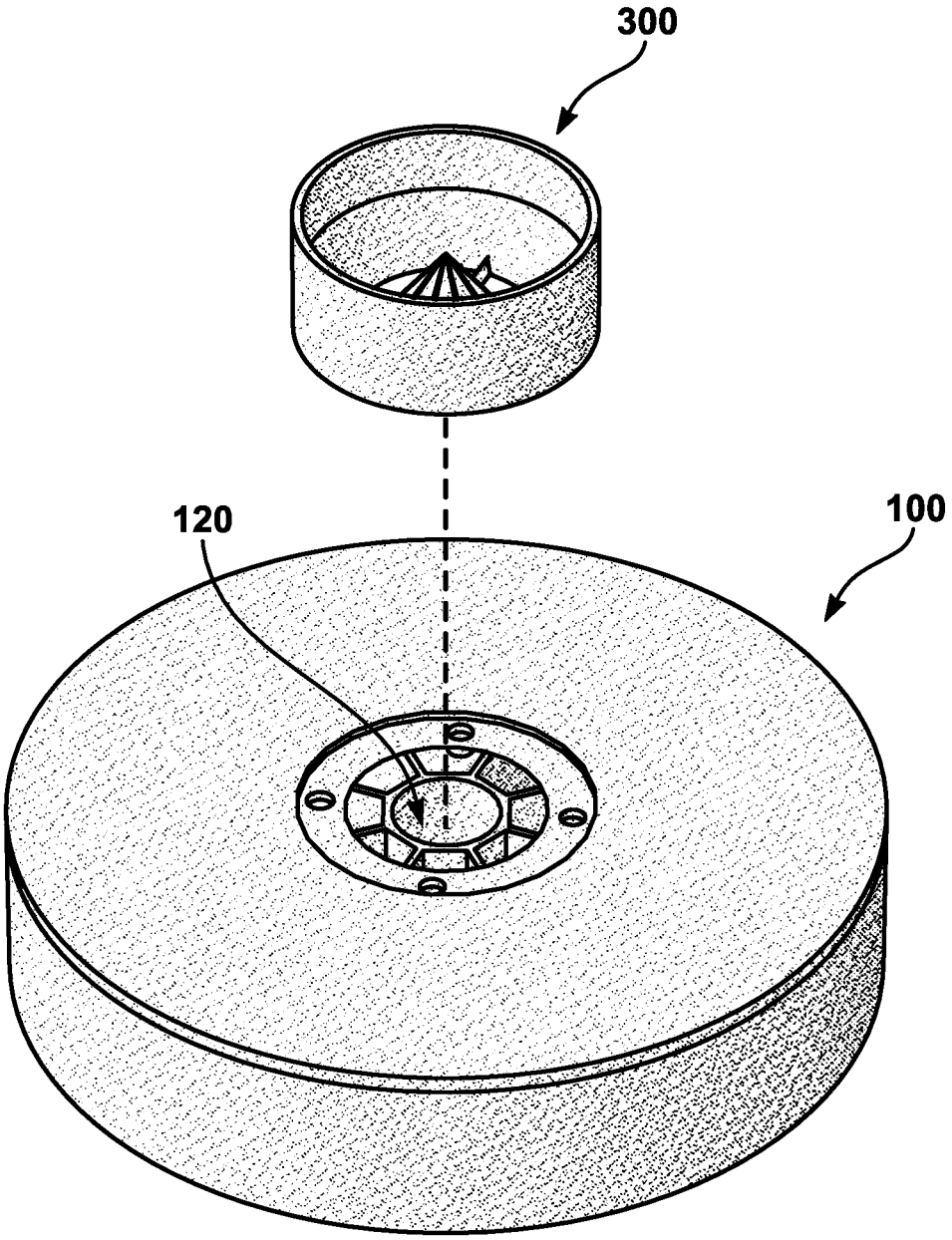
FIG. 5 is a view of an embodiment of a fill funnel shown with a weight plate of the present invention.

Returning once more to FIG. 4, in an embodiment of the invention, each compartment 160 comprises a partial sloped floor 162 so that when the hollow weight plate is being filled, the loose filler material flows away from the center. While this is not required for practicing the present invention, it is a desirable feature because it makes filling the hollow weight plate easier. The exact angle between the sloped floor 162 and the bottom of the main body can be any angle conducive to the loose filler material flowing away from the opening. The hollow weight plate is preferably filled by means of funnel 300, shown in FIG. 5.

Figure 6A:
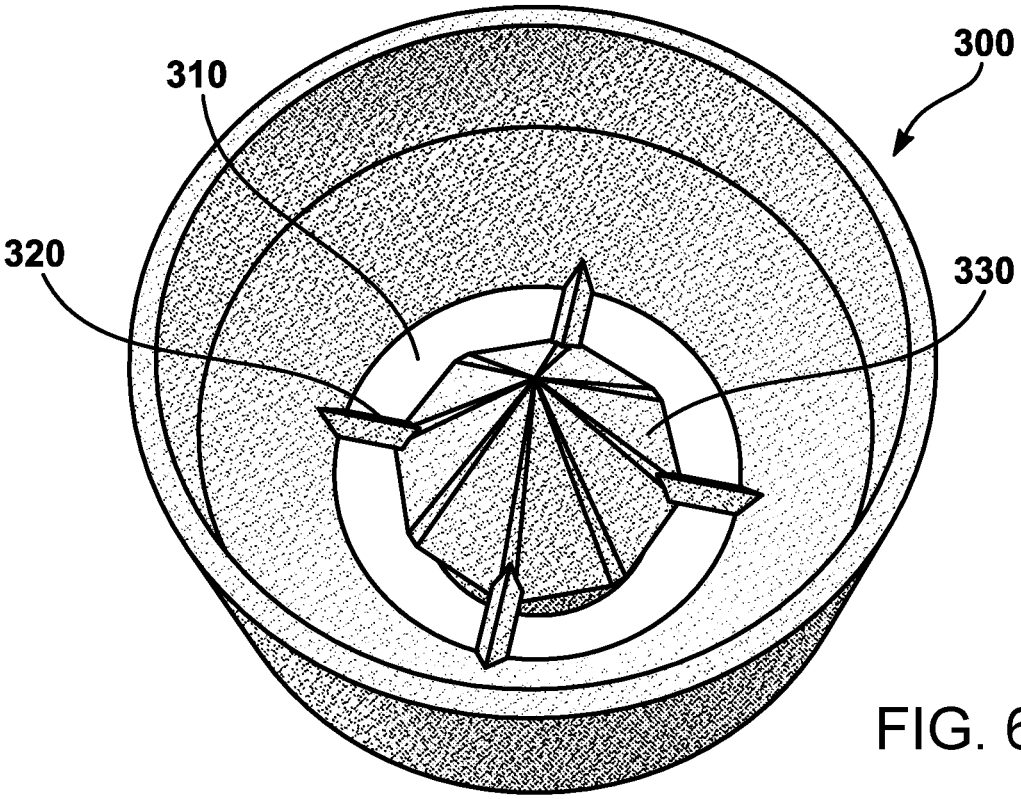
FIG. 6A is a view of an embodiment of a fill funnel of the present invention, seen from the top.
Figure 6B:
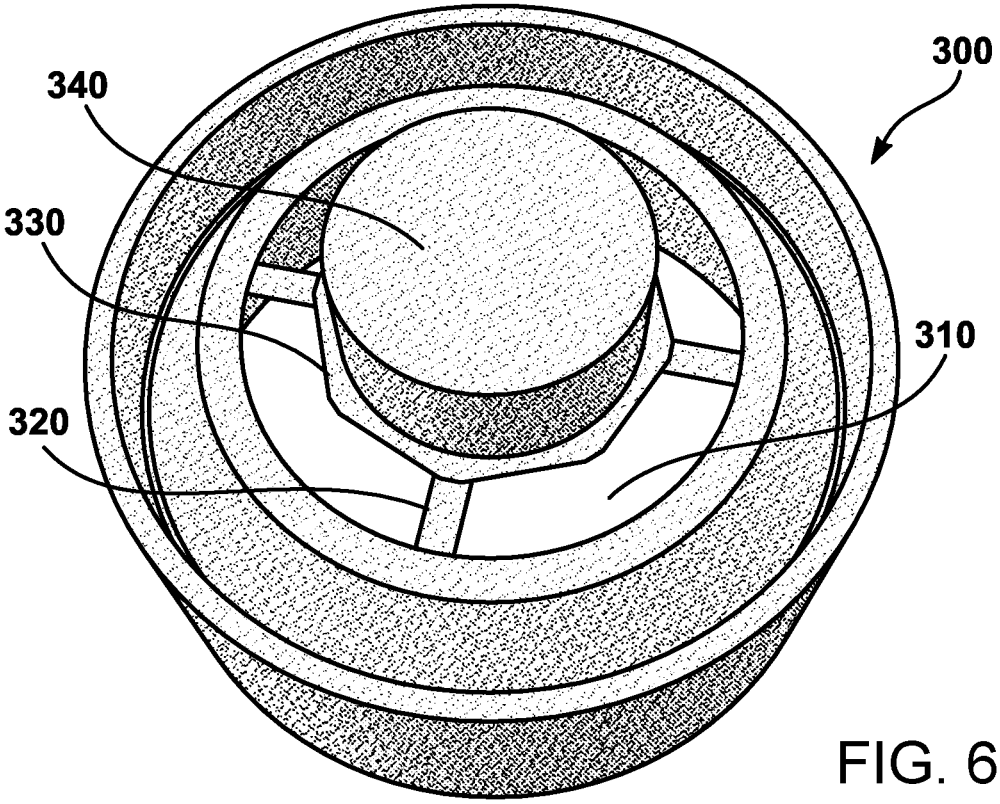
FIG. 6B is a view of an embodiment of a fill funnel of the present invention, seen from the bottom.
Figure 7:
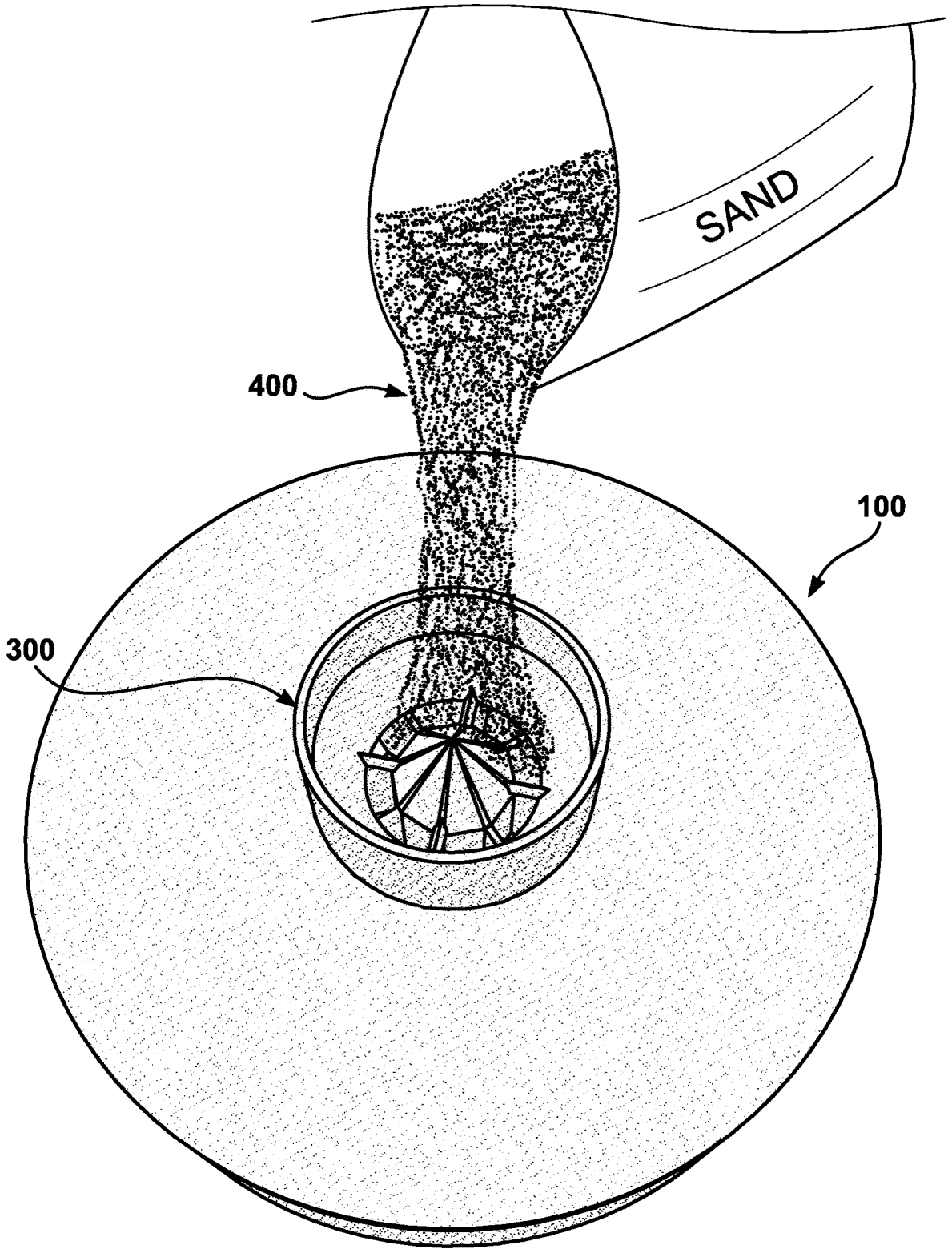
FIG. 7 is a view of an embodiment of a weight plate of the present invention being filled with sand.

The funnel 300 is shaped in such a way that it can direct sand into the opening in the top side of the hollow weight plate (with the center collar cover taken off), in such a way that the sand is guided into each interior compartment and not into the center hole of the weight plate. FIGS. 6A and 6B show the funnel 300, seen from the top in FIG. 6A and from the bottom in FIG. 6B. As can be seen in the Figures, the funnel 300 comprises a center cover 330 that covers the center hole of the weight plate, preventing sand from falling through. The underside of the center cover 330 comprises a plug 340 that fits exactly into the center hole of the weight plate. While this is not a required part of the invention, the plug 340 prevents sand from falling into the center hole of the weight plate and making a mess. The center cover 330 is held in place with four linear members 320, which are preferably shaped in such a way as to not significantly cover the opening 310. While four linear members 320 are shown in the Figure, it is to be understood that any number of linear members is also acceptable for practicing the present invention, as long as it is sufficient to hold the plug 340 in place on the funnel 300. When the funnel is in place, sand can be poured into it and will fall evenly into each of the interior compartments, filling each one with approximately the same amount of sand. FIG. 7 shows the hollow weight plate being filled with sand 400 through the funnel.

Figure 8A:
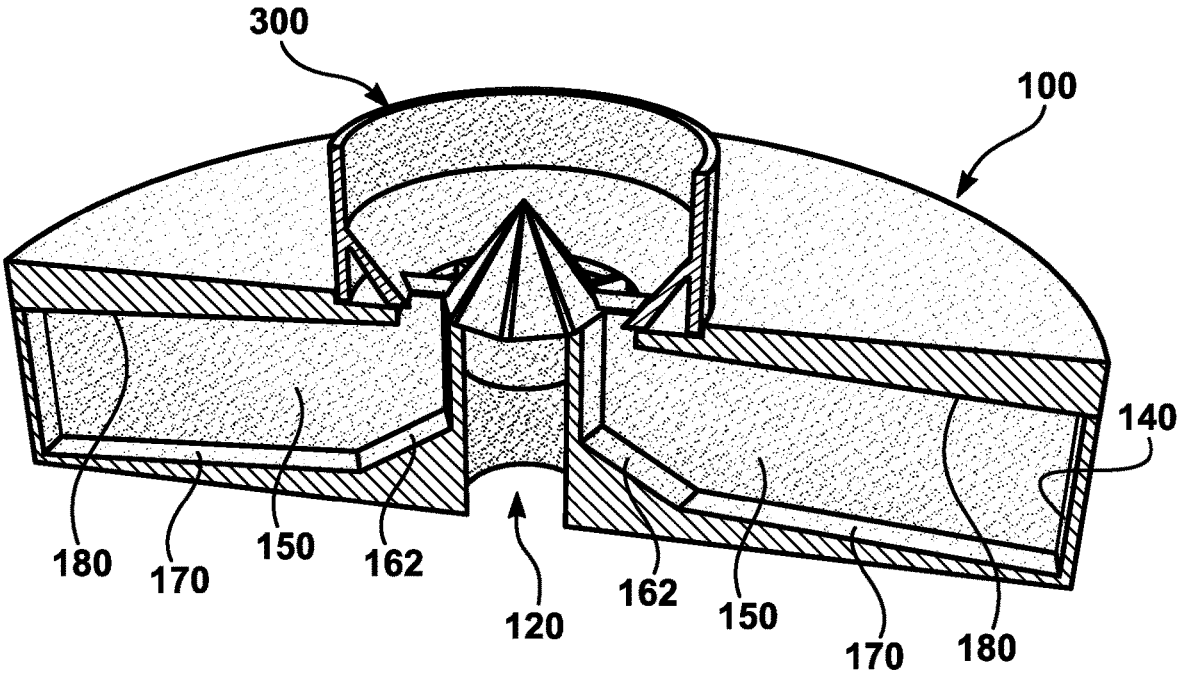
FIG. 8A is a cross-sectional view of an embodiment of a weight plate of the present invention with a fill funnel installed.

In an embodiment of the present invention, the hollow weight plate comprises a sloped top surface to make it easier to empty out the sand if desired, and/or a sloped bottom surface to make the sand flow all the way to the outside of the hollow weight plate when it is being filled. FIG. 8A shows a cross-sectional view of the hollow weight plate of this embodiment. As can be seen in the Figure, the bottom side of the interior compartment 170 is sloped so that sand flows down toward the outer edge of the hollow weight plate. The slope of the bottom side may be 5°, but may also be any other angle sufficient for the sand to flow away from the opening and toward the outer edge of the hollow weight plate.

Figure 8B:
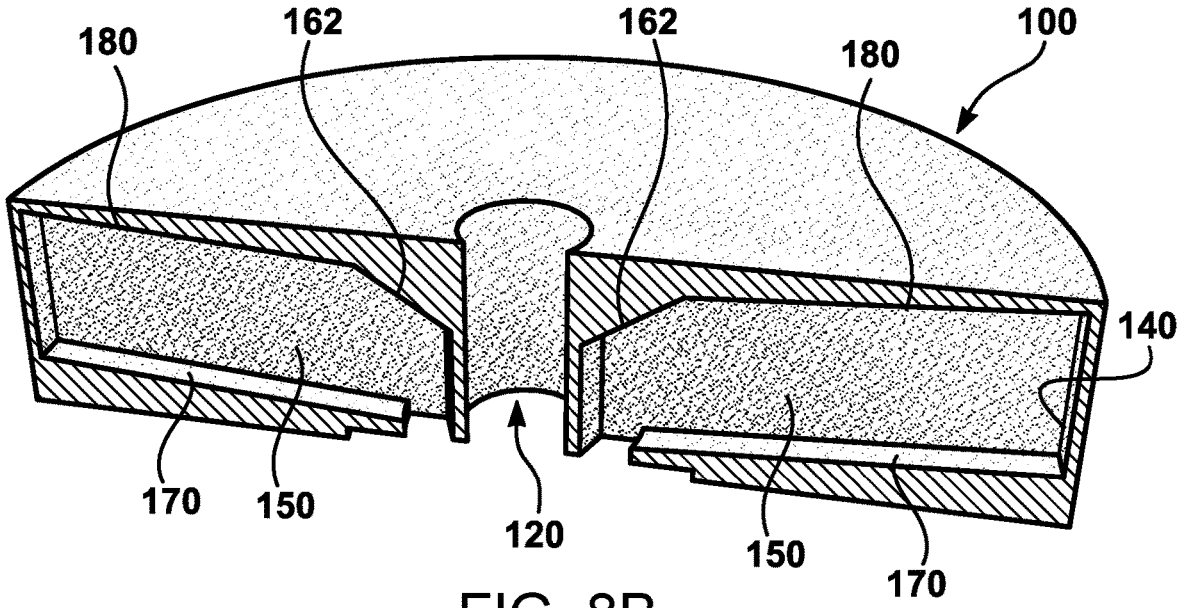
FIG. 8B is a cross-sectional view of an embodiment of a weight plate of the present invention without a fill funnel installed.

In an embodiment of the present invention, as shown in FIG. 8B, the hollow weight plate comprises a sloped top surface 180 to make it easier to empty the sand out of the hollow weight plate when needed. The entire inner surface of the top side 180 is preferably sloped at an angle of 5°. The angle may also be any other angle sufficient for the sand to flow out when the hollow weight plate is placed with the opening side down.

The hollow weight plate of the present invention may be made in different sizes to account for different desired weight ranges, as long as the radius of the inner hole on the weight plate is suitable for placing on a barbell or dumbbell. There are several standardized weights for Olympic barbell training, namely 45 lbs., 25 lbs., 10 lbs., 5 lbs., and 2.5 lbs. The standard 45 lb. weight plate has a diameter of 17.5"; the other standard weight plates have varying diameters and thicknesses, depending on brand. In an embodiment of the present invention, several sizes of plates are offered to accommodate the above listed weights of sand, and the 45 lb. plate is 17.5" in diameter. The thickness of the 45 lb. plate preferably is such that it accommodates 45 lbs. of sand; the dimensions of the other plates are also such that they accommodate the listed weights of sand.

In other embodiments, different weights or sizes of the hollow weight plate are provided, and the present invention is not limited to the standardized weights described above.

The opening in the top side of the hollow weight plate is preferably wide enough to enable the hollow weight plate to be easily filled or emptied. Preferably, the opening is not too wide, since that would necessitate a larger collar flat portion, which is made of metal and therefore heavier than the plastic main body of the hollow weight plate. However, if the opening is too small, it will be difficult to fill or empty the hollow weight plate.

Exemplary embodiments are described above. It is to be understood that the present invention encompasses other embodiments that form reasonable equivalents to the above described embodiments, and that it is limited only by the appended claims.

The invention claimed is:

1. A hollow weight plate that may be filled with material to adjust its weight, comprising:

a. a main body, wherein the main body comprises:

i. a flat circular bottom side with a circular hole in the middle, wherein the circular hole and the bottom side are concentric;

ii. an outer cylindrical wall extending from an exterior edge of the flat circular bottom side, wherein the outer cylindrical wall is approximately perpendicular to the flat circular bottom side;

iii. an inner cylindrical wall extending from an edge of the circular hole, wherein the inner cylindrical wall is approximately perpendicular to the flat circular bottom side, wherein a height of the inner cylindrical wall is the same as a height of the outer cylindrical wall;

iv. at least two dividers extending from the inner cylindrical wall to the outer cylindrical wall to form at least two interior compartments, wherein each of the at least two dividers is approximately perpendicular to the flat circular bottom side, wherein a height of each of the at least two dividers is the same as the height of the outer cylindrical wall;

v. a top side, wherein the top side is flat and circular and has approximately the same radius as the flat circular bottom side, wherein the top side is located parallel and concentric to the flat circular bottom side, wherein the top side comprises a top hole that extends over the center of the top side, wherein the top hole is larger than the circular hole so that a portion of each of the at least two interior compartments is accessible from the outside;

b. a center collar cover, wherein the center collar cover comprises:

i. a collar flat portion that is approximately the same size and shape as the top hole, wherein the collar flat portion comprises a circular hole;

ii. a collar cylindrical wall extending from an edge of the circular hole, wherein the collar cylindrical wall is of a size that enables it to fit inside the inner cylindrical wall;

c. wherein the center collar cover is fastened on the top side in such a way that the collar flat portion is in contact with an edge of the top hole and the collar cylindrical wall is inside the inner cylindrical wall.

2. A system for adjusting the weight of a weight plate, comprising:

a. the hollow weight plate of claim 1;

b. a funnel, comprising:

i. a smaller opening approximately similar in size and shape to the top hole;

ii. a cover located in the middle of the smaller opening, wherein the cover is at least the same size and shape as the inner cylindrical wall;

iii. a larger opening that is larger than the smaller opening;

c. an amount of filler material that can be poured through the funnel into the at least two interior compartments of the main body.

3. The system of claim 2, wherein the filler material is sand.

4. The hollow weight plate of claim 3, wherein the at least one internal stiffener has a hexagonal structure.

5. The system of claim 2, wherein the filler material comprises a cementing agent to bind the filler material into a solid.

6. The hollow weight plate of claim 1, wherein the center collar cover is made of metal.

7. The hollow weight plate of claim 1, comprising at least four interior compartments.

8. The hollow weight plate of claim 1, comprising at least six interior compartments.

9. The hollow weight plate of claim 1, wherein the top side comprises an outer surface and an inner surface, wherein the bottom side comprises an outer surface and an inner surface, wherein the inner surface of the top side is slanted so that a distance between the inner surface of the top side and the outer surface of the bottom side, measured close to an exterior edge, is smaller than a distance between the inner surface of the top side and the outer surface of the bottom side, measured close to the top hole.

10. The hollow weight plate of claim 1, wherein the top side comprises an outer surface and an inner surface, wherein the bottom side comprises an outer surface and an inner surface, wherein the inner surface of the bottom side is slanted so that a distance between the inner surface of the bottom side and the outer surface of the top side, measured close to an exterior edge, is smaller than a distance between the inner surface of the bottom side and the outer surface of the top side, measured close to the top hole.

11. The hollow weight plate of claim 1, wherein the bottom side comprises an outer surface and an inner surface, wherein a partial sloped floor is located on the inner surface of the bottom side, wherein the partial sloped floor is concentric with the bottom side and extends part of the way up the inner cylindrical wall and part of the way over the inner surface of the bottom side.

12. The hollow weight plate of claim 1, wherein the main body is made of one of the following: plastic, rubber.

13. The hollow weight plate of claim 1, wherein at least one of the interior compartments comprises at least one internal stiffener, wherein the at least one internal stiffener is located in such a way as to not block filler material from flowing through.

14. The hollow weight plate of claim 1, wherein the collar cylindrical wall has an inner diameter of 1".

15. The hollow weight plate of claim 1, wherein the collar cylindrical wall has an inner diameter of 2".

* * * * *